US006199343B1

(12) United States Patent
Sauer et al.

(10) Patent No.: US 6,199,343 B1
(45) Date of Patent: Mar. 13, 2001

(54) CONNECTOR ASSEMBLY FOR CEILING GRID

(75) Inventors: Gale E. Sauer, Sinclairville, NY (US); Yu Lin; Larry S. Wertz, Jr., both of West Chester, PA (US)

(73) Assignee: Worthington Armstrong Venture, Malvern, PA (US)

( * ) Notice: Subject to any disclaimer, the term of this patent is extended or adjusted under 35 U.S.C. 154(b) by 0 days.

(21) Appl. No.: 09/295,223

(22) Filed: Apr. 19, 1999

(51) Int. Cl.[7] ..... E04B 9/00

(52) U.S. Cl. ..... 52/664; 52/506.07; 52/667; 403/347

(58) Field of Search ..... 52/506.07, 506.08, 52/664, 665, 667, 655.1; 403/347

(56) References Cited

U.S. PATENT DOCUMENTS 4,106,878 * 8/1978 Jones ..... 52/664 X
4,108,563 * 8/1978 Brown et al. ..... 403/347
4,317,641 * 3/1982 Sauer ..... 52/667
4,611,453 * 9/1986 Worley ..... 52/506.07 X
4,779,394 * 10/1988 Shirey et al. ..... 52/506.07 X
5,687,525 * 11/1997 Koski et al. ..... 52/506.07
5,761,868 * 6/1998 LaLonde et al. ..... 52/506.07
5,839,246 * 11/1998 Ziegler et al. ..... 52/506.07

* cited by examiner

*Primary Examiner*—Beth A. Stephan
*Assistant Examiner*—Brian E. Glessner
(74) *Attorney, Agent, or Firm*—Eugene Chovanes

(57) ABSTRACT

A hook type assembly that interlocks a pair of intersecting cross-beams and a main beam in a grid for a suspended ceiling. A gapped ridge in a clip on each cross-beam engages the other gapped ridge in a vertical movement that is part of a hooking action while the assembly is formed. The assembly can be optionally made to provide for expansion during a tire.

10 Claims, 11 Drawing Sheets

CONNECTOR ASSEMBLY FOR CEILING GRID

BACKGROUND OF THE INVENTION

1. Field of the Invention

This invention relates to a grid structure for a suspended ceiling, and more particularly to the assembly that interlocks a pair of intersecting cross-beams and a main beam in such grid structure.

2. Background Information

Suspended ceilings having a metal grid structure framework, which supports acoustical panels within rectangular enclosures formed by the grid, are used extensively in commercial and industrial buildings. The grid is suspended from a structure above the ceiling.

Such grid, as is well known, consists generally of parallel extending main beams and intersecting cross-beams. At an intersection, the main beam has a slot in its web which receives a pair of connector clips, with each connector clip, which is on the end of a cross-beam, inserted from opposing sides of the web to form a connector assembly. Such assemblies sometimes interlock the opposing cross-beams to the main beam in a first lock only, but more generally also have a second lock that interlocks the two cross-beams to each other.

Where it is particularly necessary that the assembly resist tension forces that tend to pull the assembly apart, as for instance from seismic events, as well as compressive forces, which tend to push the assembly apart, a first and second lock as referred to above is used. Where the compressive forces arise from fire, it may be desirable to provide expansion means in the assembly to keep the beams directionally in place to retain the panels in the ceiling.

One type of prior art assembly is the stab type, wherein the cross-beam connector clips are inserted into the main beam slot by a longitudinal thrust stab action. Another type of assembly is the hook type, wherein the cross-beam is hooked into the assembly.

Prior art assemblies of the stab type, generally depend on a spring action to engage components to interlock the clips to the main beam in the first lock, and to each other in a second lock. Such spring action is often complicated and does not provide a particularly high degree of resistance to separation from either tension or compressive forces, since the spring components must be made relatively light.

Prior art assemblies of the hook type, without spring action, generally only connect the cross-beams to the main beam in a first lock, without connecting the cross-beams to each other in a second lock. Such hook types are of rigid construction and are relatively simple to make and install, but lack substantial resistance to tension that pulls the assembly apart because of the lack of the second lock.

SUMMARY OF THE PRESENT INVENTION

The present invention is for a hook lock assembly that interlocks a main beam and two intersecting cross-beams in a first lock, and the cross-beams to each other in a second lock, in a simple and positive way. The second lock is formed by a connector clip on the end of a cross-beam that interlocks with an identical connector clip on another cross-beam within a slot on the main beam by means of a rigid gapped ridge that extends longitudinally on each clip.

The second lock is engaged as the hook on the second clip is moved vertically downward to engage the hook with the web of the main beam. This vertically downward movement causes the gapped ridge of one clip to intermesh and interlock with the gapped ridge of the other clip. The gaps in one clip are aligned with the ridge portions between the gaps in the other clip when vertical downward movement occurs, as guided by a generally vertical shoulder. Both first and second locks are of the positive type, without spring action.

The assembly, by means of the combination of both locks, strongly resists tension forces, such as imparted to a ceiling from a seismic event, in a simple effective way.

The assemblies can be made to permit expansion from fire, or alternatively, to resist expansion. A stop in the assembly made in the form of a shearable tab permits beam expansion from fire, or in the alternative, the stop can be relatively solid to resist expansion.

BRIEF DESCRIPTION OF THE DRAWINGS

FIG. 1 is an enlarged isometric view of the cross-beam connector clip of the invention.

FIG. 2 is a side elevational view of the connector clip shown in FIG. 1.

FIG. 3 is a plan view of FIG. 2.

FIG. 4 is a left hand end elevational view of FIG. 2.

FIG. 5 is a right hand end elevational view of FIG. 2.

FIG. 6 is a rear side elevational view of FIG. 2.

FIG. 7 is an enlarged fragmentary side elevational view showing one end of a cross-beam having a connector clip such as shown in FIGS. 1–6 attached to its terminal end and positioned with respect to the slot of the main beam prior to securing the cross-beam to the main beam in the first lock. The cross-beam, connector clip and main beam details are shown in full line and the initial insertion of the connector clip within the slot of the main beam is shown in dot and dash outline.

FIG. 8 is a plan view of FIG. 7 with some portions broken away and in section to show certain details of construction.

FIG. 9 is an enlarged fragmentary side elevational view taken on the line 9,9 of FIG. 7 showing details of the main beam and its slotted slot for the insertion of confronting cross-beam connector clips.

FIG. 10 is a side elevational view similar to FIG. 7 but showing the connector clip of the cross-beam inserted within the slot of the main beam to its initial limit position, just prior to completing a first lock. The cross-beam and associated connector clip as well as the main beam are then slightly angularly positioned with respect to one another to allow the connector clip of the cross-beam to be forced downwardly with respect to the slot of the main beam as shown by the arrow to complete a first lock.

FIG. 11 is a side elevational view similar to FIGS. 7 and 10 of the drawings but showing the cross-beam and associated connector clip of FIG. 10 in a seated in a first lock position. In addition, there is shown, in full line, the fragmented terminal end of an opposed cross-beam and connector clip, spacedly positioned with respect to the slot of the main beam, prior to securing the opposed cross-beam to the main beam to complete the first lock. The initial insertion of the opposed connector clip of the opposed cross-beam within the slot of the main beam is shown in dot and dash outline.

FIG. 12 is a fragmentary sectional elevational view taken on the line 12,12 of FIG. 11 showing the positioning of the connector clip of the cross-beam of FIGS. 7, 10 and 11 in a first lock position within the slot of the main beam.

FIG. 13 is a side elevational view similar to FIG. 11 of the drawings but showing the connector clip of the opposed cross-beam inserted within the slot of the main beam to its initial limit position, the opposed cross-beam and associated connector clip are angularly disposed with respect to the main beam and slot prior to forcing the opposed connector clip downwardly as shown by the arrow into a completed first lock and second lock position. Portions of the locked-in connector clip of FIG. 11 have been broken away, for clarity, and the profile of the connector clip overlying the opposed connector clip is shown in dot and dash outline.

FIG. 14 is a fragmentary sectional elevational view taken on the line 14,14 of FIG. 13 showing the relative positions of the cross-beam connector clips within the slot of the main beam just prior to completing the first and second locks of the opposed cross-beam and associated connector clip to the main beam and adjacent cross-beam connector clip.

FIG. 15 is a side elevational view similar to FIG. 13 showing the assembly of the invention with the first and second locks engaged.

FIG. 16 is a fragmentary sectional elevational view taken on the line 16,16 of FIG. 15 showing the interlocked positioning of the connector clips within the slot of the main beam when the first and second locks are engaged.

FIG. 17 is a fragmentary sectional plan view taken on the line 17,17 of FIG. 15 showing the axial alignment of the cross-beams when their connector clips are in interlocking engagement within the slot of the main beam with the first and second locks engaged.

FIG. 18 is an enlarged fragmented sectional elevational view similar to FIG. 15 but showing the first step in freeing one end of an interlocked cross-beam from the assembly of interlocked cross-beams and main beams.

FIG. 19 is a view similar to FIG. 18 showing the remaining step in removing the freed end of a cross-beam from an assembly of interlocked cross-beams and main beams.

FIG. 20 is an enlarged fragmenting sectional elevational view similar to FIG. 15 but showing the left hand terminal end and associated interlocking connector clip being moved toward the right hand cross-beam through the slot of the main beam due to expansion of the left hand cross-beam from a source of heat:

Figure 15:
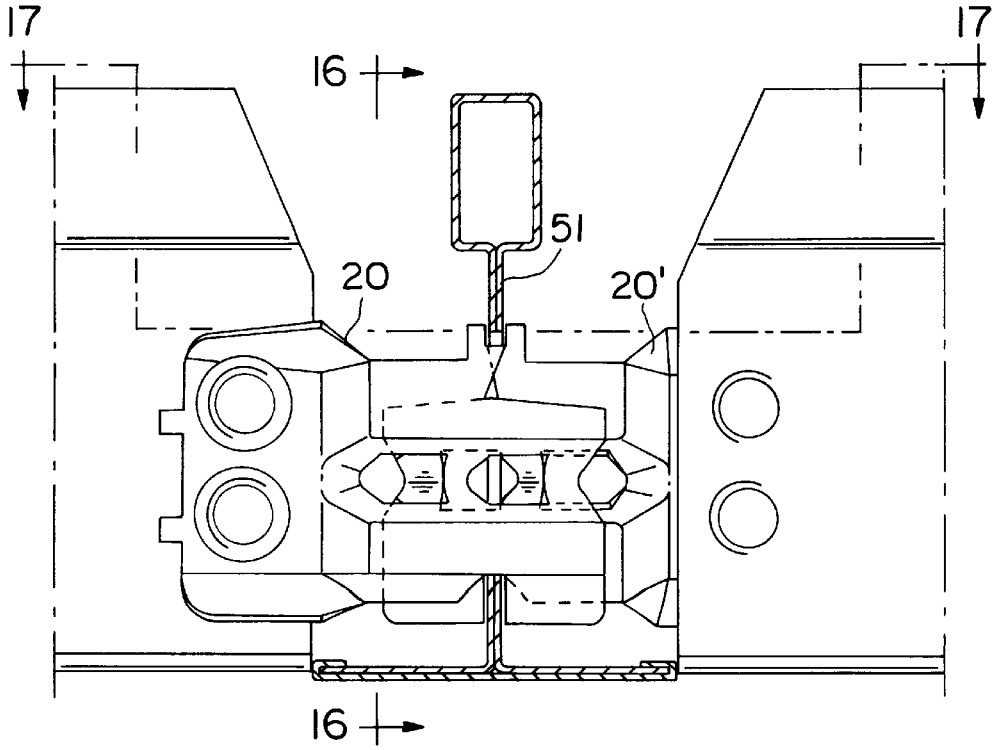

a) upper tab sheared away;

b) left hand connector clip being moved upwardly and inwardly out of engagement with the gaps in the ridge of the opposing connector clip, compared to FIG. 15.;

c) lower flange of cross-beam is raised above the upper surface of the main beam flange;

d) the upward movement of the connector clip is created by the contact of the cam face on the lower end of the connector clip and the lower edge of the slot in the main beam.

Figure 20:
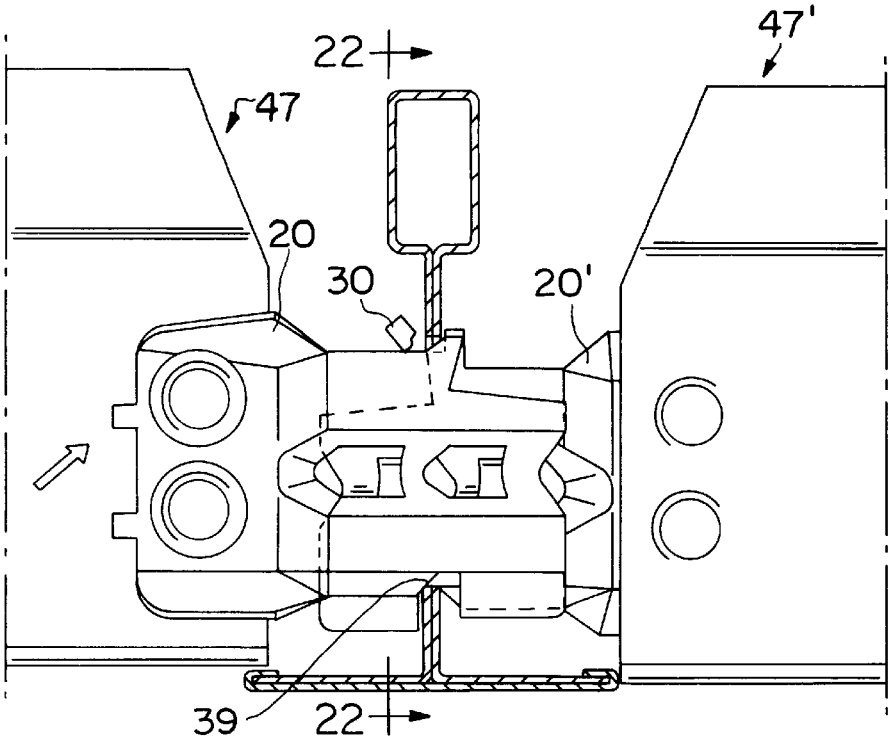
FIGS. 20 to 26 show a connector clip assembly expansion under fire conditions.
Figure 21:
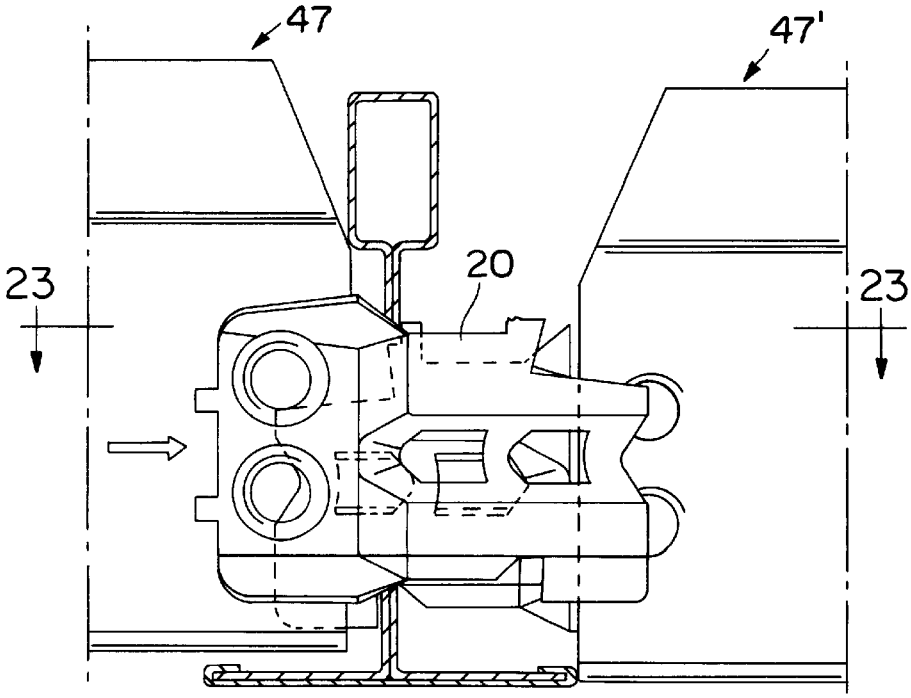

FIG. 21 is a view similar to FIG. 20 but showing the left hand cross-beam terminal end and associated connector clip having moved its connector clip through the slot of the main beam to its cross-beam expansion limit.

Figure 16:
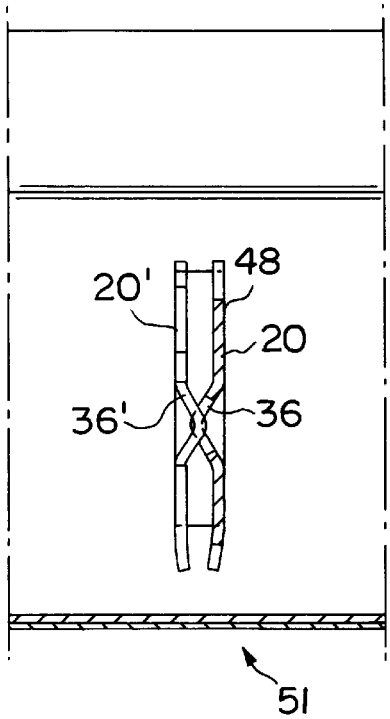
Figure 22:
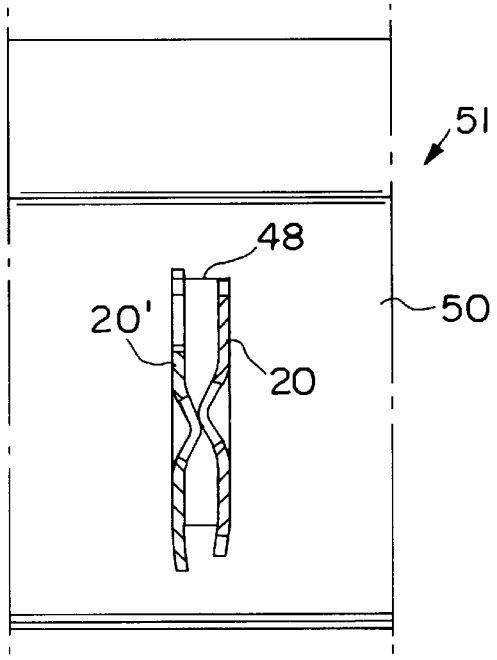

FIG. 22 is a fragmentary sectional elevational view taken on the line 22,22 of FIG. 20 showing the separation of the ridges of the opposed interlocking connector clip of the cross-beams within the slot of the main beam.

a) with reference to FIGS. 15, 16 and compared to FIGS. 20, 22 it can be seen that the interlocked gaps in the ridges of the cross-beam connector clips are disengaged, as shown in FIG. 22 as the left hand connector clip moves upwardly and inwardly toward the opposing connector clip.

b) the apexes of the gaps in the ridges and their sides no longer interengage with each other.

c) the left hand connector clip can now advance to the right, its gapped ridge raised above the plane of the opposed gapped ridge.

Figure 23:
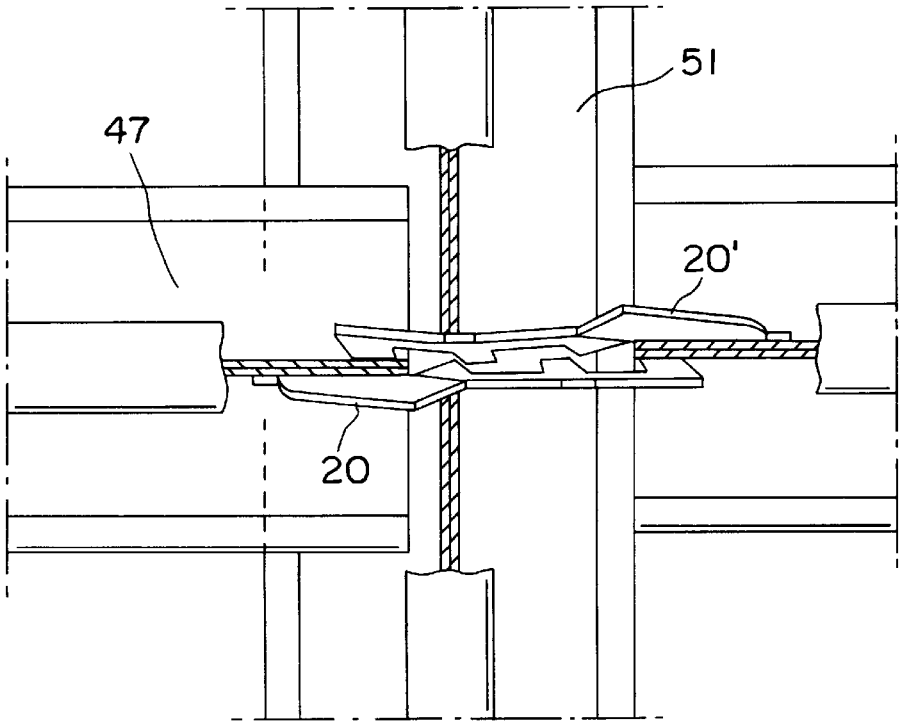

FIG. 23 is a fragmentary sectional plan view taken on the line 23,23 of FIG. 21 showing details of the left hand cross-beams terminal end and associated connector clip having traveled to its limit of expansion due to a source of heat as shown in FIG. 21 and the corresponding horizontal displacement of the cross-beams axial center lines and flexing of the right hand connector clip with respect to the slot in the web of the main cross-beam.

a) resistance forces during expansion are generated by the ridge of the connector clips engaging the vertical end faces of the opposed cross-beam webs and the frictional forces generated by the side walls of the connector clips with side walls of the slot in the main cross-beam, which exerts a pinching effect on the connector clips.

Figure 24:
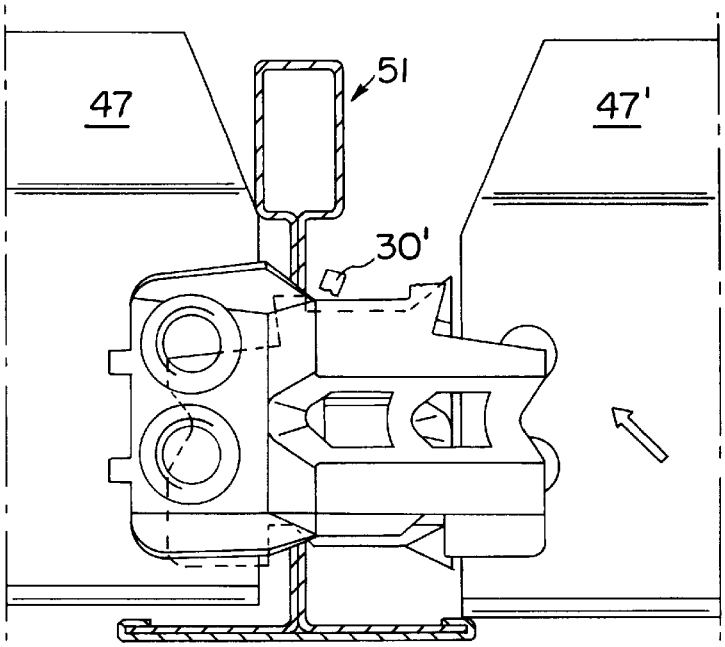

FIG. 24 is a view similar to FIG. 21 but showing the right hand terminal end of the right hand cross-beam and its associated chip expanding due to a continued source of heat against the opposed fully expanded left hand cross-beam and connector clip.

a) the upper tab of the right hand connector clip is sheared away;

b) the upper right hand connector clip rises due to the inclined front face of the lower flange engaging the lower edge of the main beam slot until the apexes of the gaps in the ridge of both connector clips comes into contact. See FIG. 23.

c) since the right hand connector clip is prevented from rising fully, the lower edge of the bottom flange must cut through the corner of the slot on the lower right hand side;

d) the bottom flange of the right hand cross-beam is raised enough to ride over the bottom flange of the main beam.

Figure 25:
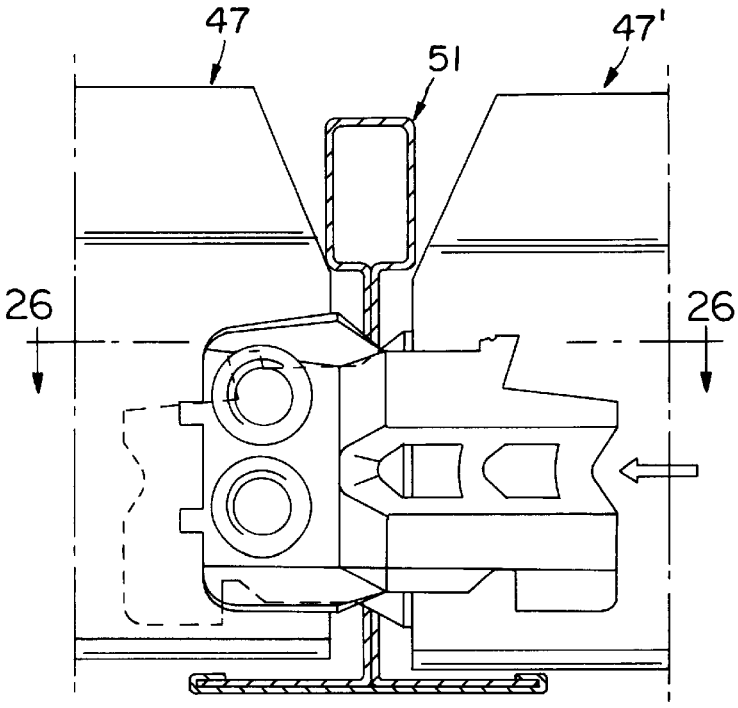

FIG. 25 is a fragmentary sectional elevational view similar to FIG. 24 but showing the right hand cross-beam terminal end and associated connector clip having traveled to its limit of expansion due to a continued source of heat.

Figure 26:
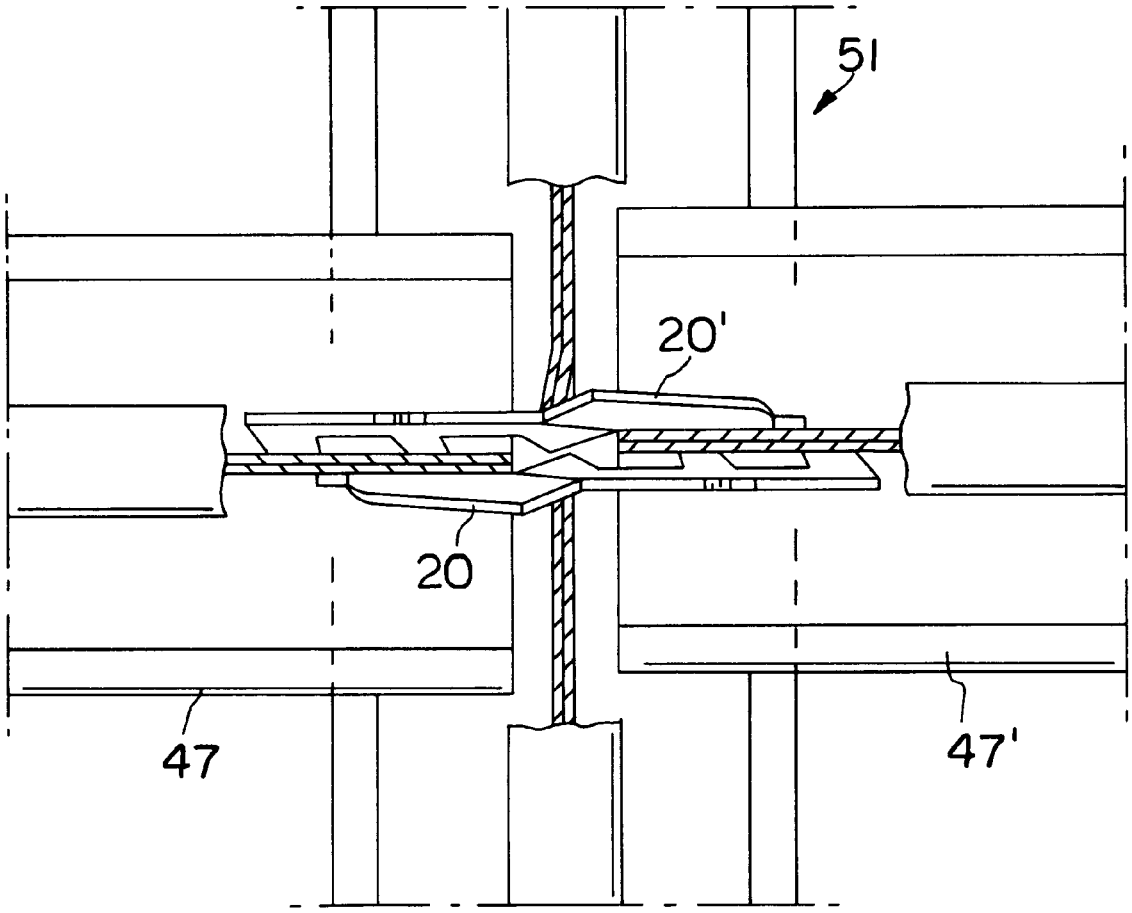

FIG. 26 is a fragmentary sectional plan view taken on the line 26,26 of FIG. 25 showing details of both terminal ends of the cross-beams and associated connector clips with respect to the slot of the main beam in their fully expanded mode.

a) slight offset of the cross-beams centerlines in the horizontal plane b) (FIG. 25) slight offset of cross-beams centerlines in the vertical plane c) deformation of slot due to frictional forces.

DESCRIPTION OF THE PREFERRED EMBODIMENT

1. Construction of Connector Clips as Seen in FIGS. 1–6.

Connector clip 20 is stamped or otherwise formed of suitable spring steel or the like. The connector clip is generally rectangular as seen in profile in FIGS. 5 and 6. The connector clip has an upper portion 21, a lower portion 22, a rear portion 23, and a front portion 24, and a middle portion 25. These portions are all in planes that are offset from one another. Each portion serves a distinct function in the connector clip assembly.

Transitional surfaces 26 serve to connect the portions together.

The rear portion 23 serves as a base to anchor the connector clip 20 to the end of a cross-beam.

Portion 23 will also be used as a datum plane to provide a reference for the other offset portions.

Holes 15 provide means to stake the connector clip onto the beam as well known. Tabs 26 are simply leftover from the forming operation wherein the connector clips are generally stamped, in groups, from strip metal, in a well known manner.

Upper portion 26 has a bevel 27, a shoulder 28, a tab 30 and a recessed shelf 31. The upper portion 21 is in a plane offset from rear portion 23.

Lower portion 22 is likewise offset from rear portions 23 and has a hook 32, a recess 33, and a shoulder 34 with a ramp 39.

The middle portion 25 is in the form of a generally V-shaped cross-section ridge 36 with gap openings 37 and 38. Gaps 37 and 38 have rear edges 40 and 41 in the form of an apex, and relatively straight rearwardly extending, front edges 42 and 43. The ridge 36 straddles the plane of the rear portion 23.

2. Clip Assembly as Seen in FIG. 7–17

Figure 1:
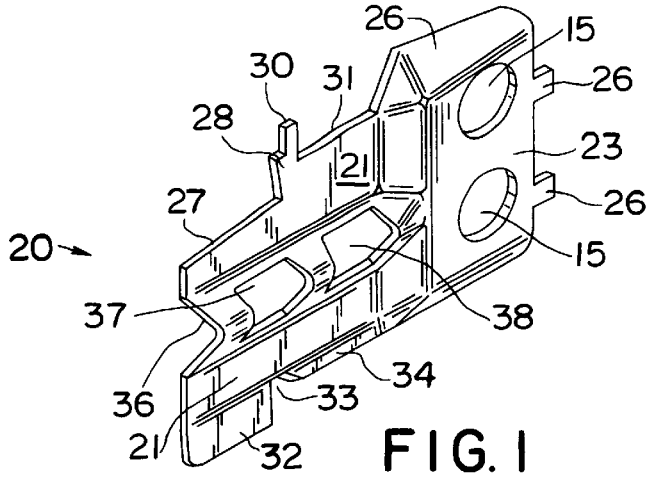
FIGS. 1–6 show the connector clip construction.
Figure 3:
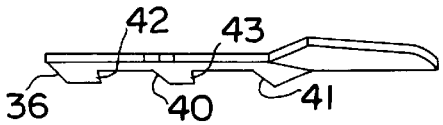
Figure 4:
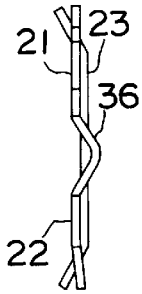
Figure 2:
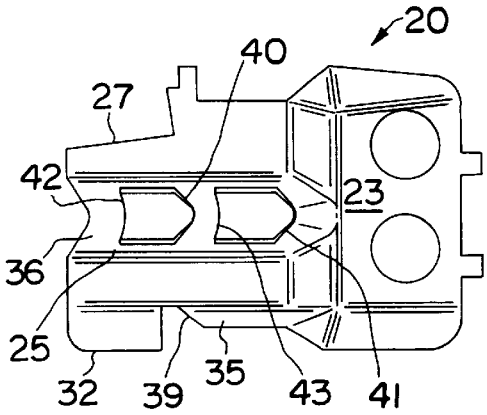
Figure 5:
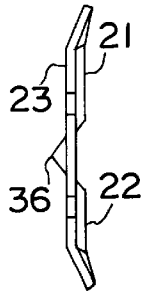
Figure 6:
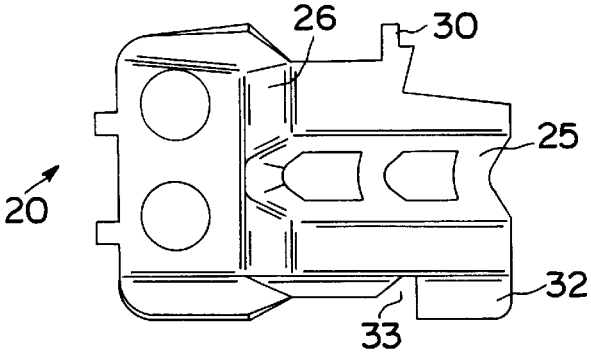
Figure 7:
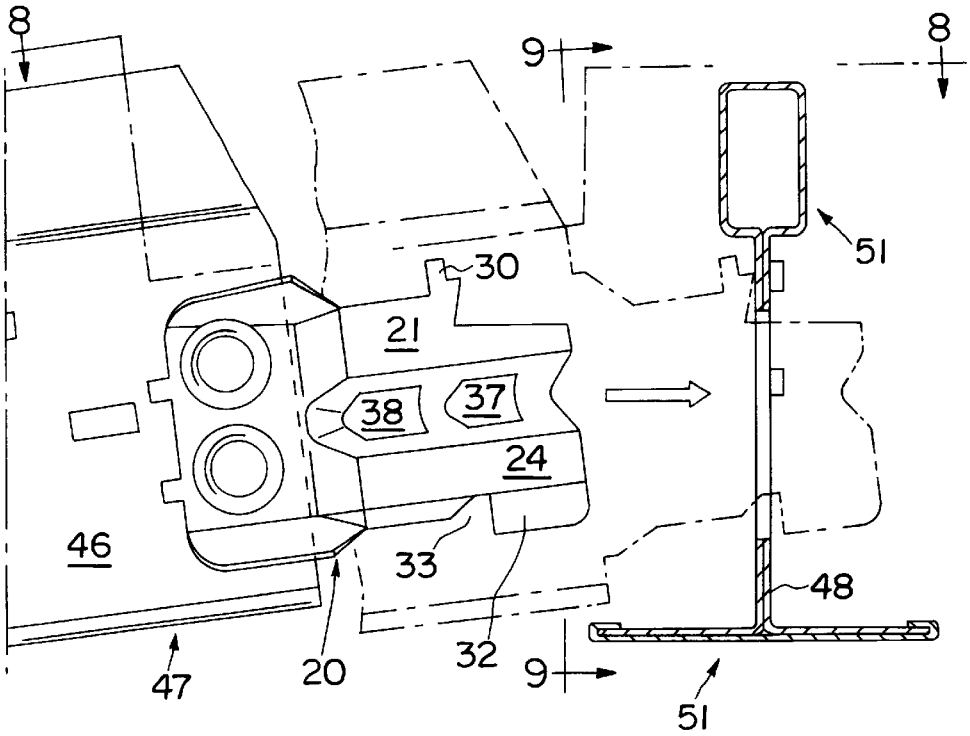
FIGS. 7–17 show an assembly with a main beam and an opposing cross beam.
Figure 8:
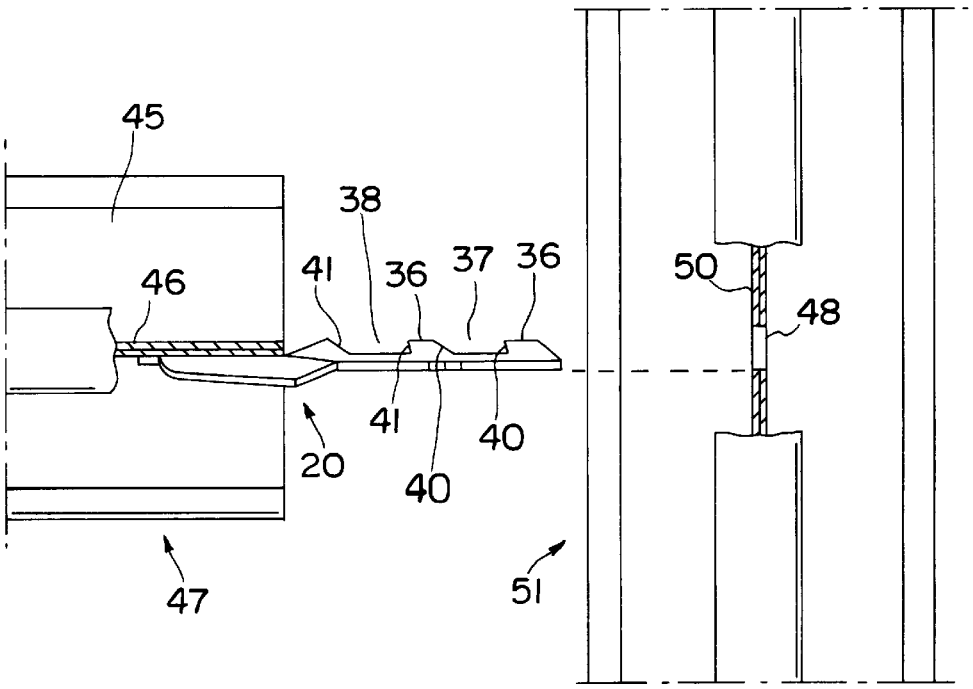
Figure 9:
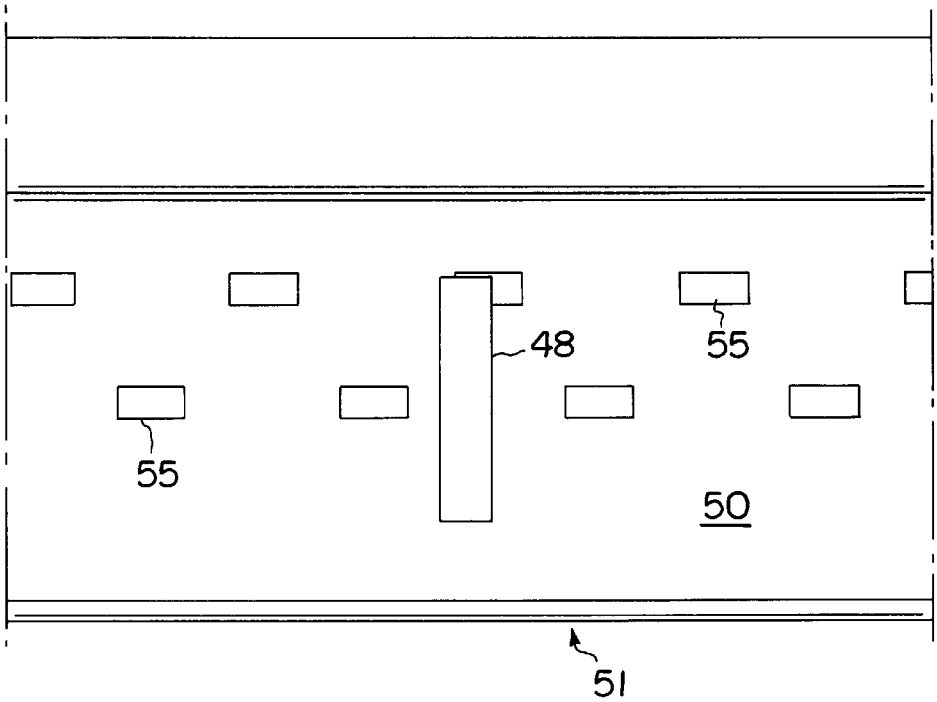

A connector clip 20 is staked 45 or otherwise fastened to the web 46 at the end of cross-beam 47. The connector clip is adapted to be inserted through slot 48 in web 50 of main beam 51. Front portion 24 is inserted through slot 48 of main beam 50 as seen in FIG. 7, in a hooking action shown in detail in the drawings, and then brought into the position as seen in solid line in FIG. 11.

Figure 10:
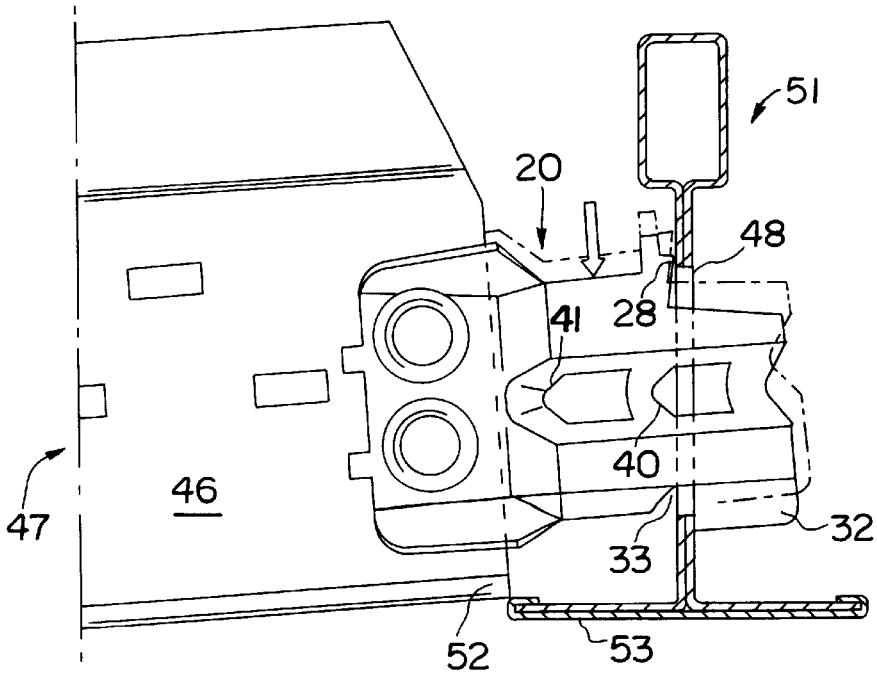
Figure 11:
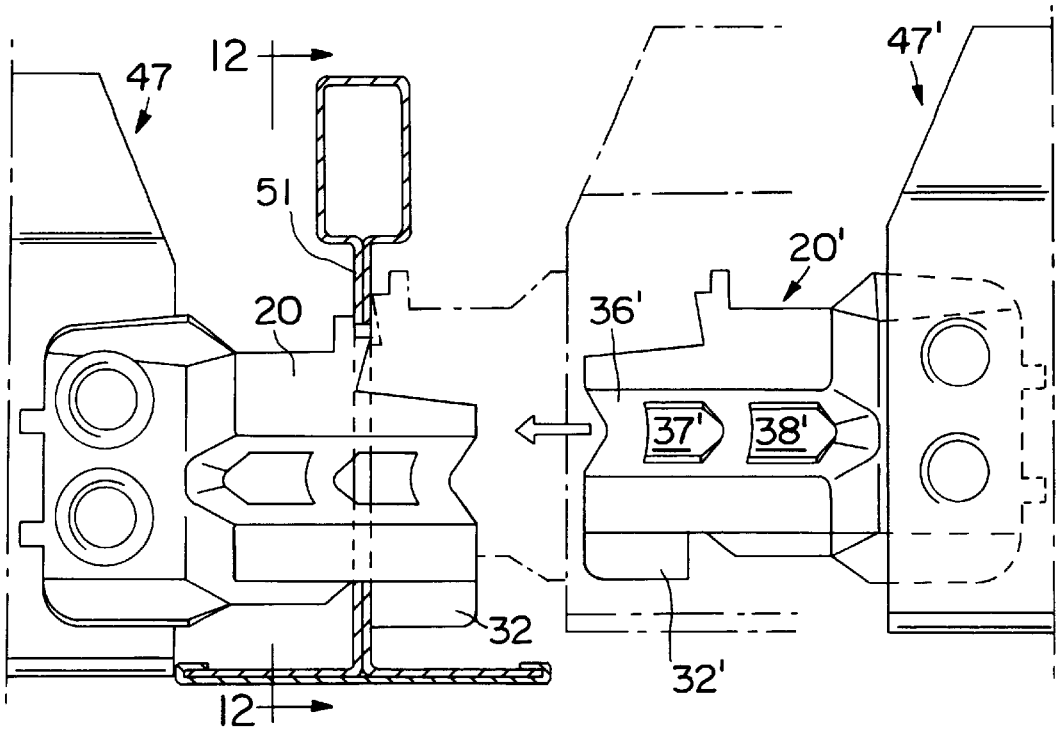
Figure 12:
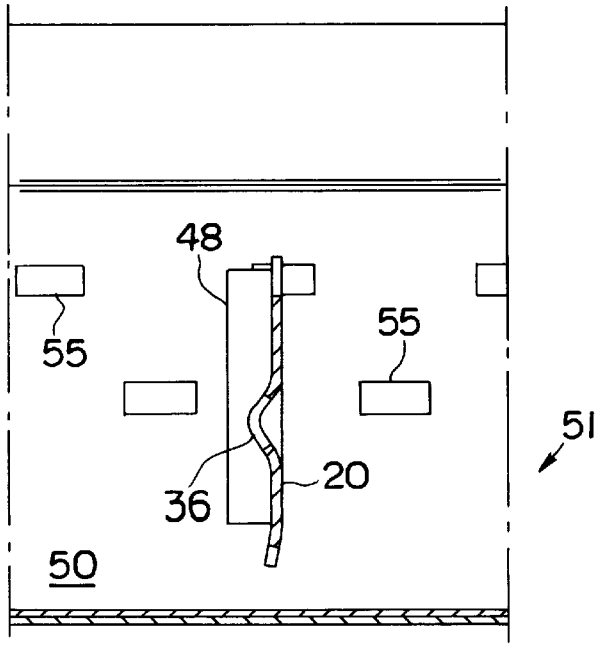
Figure 13:
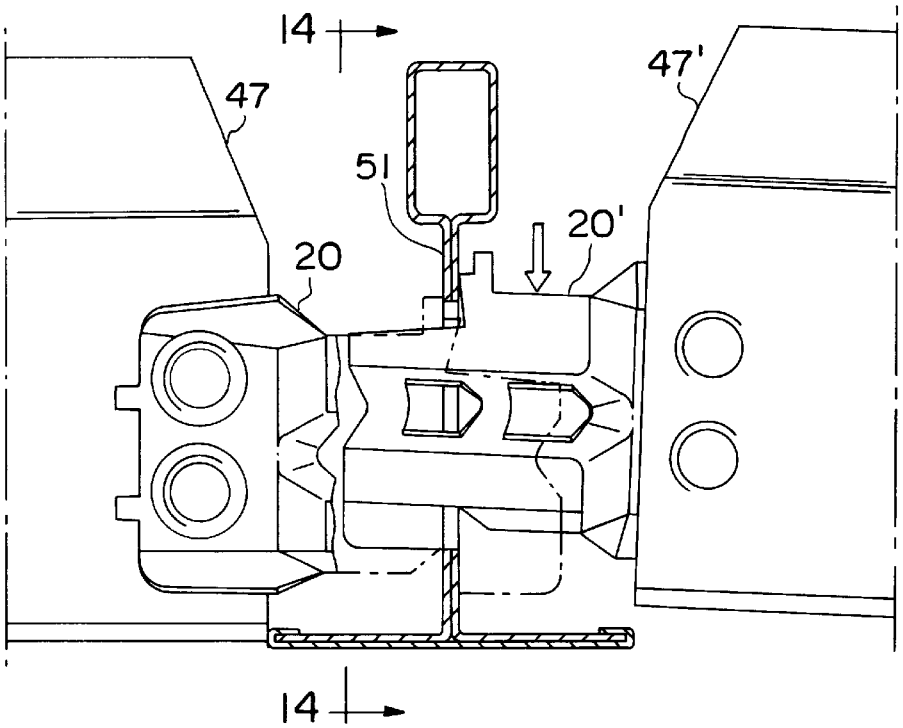

In the hooking action as seen in the drawings, there occurs a generally vertical downward movement, as seen particularly in FIG. 10. At the beginning of the downward movement, as seen in broken lines, the front portion 24 of clip 20 has passed through slot 48 in a raised position, so that hook 32 can clear the bottom of the slot. Shoulder 28 prevents further movement horizontally into the slot 48. Clip 20 is then forced downward, as shown by the arrow in FIG. 10 until shoulder 28 can clear the top of slot 48, and recess 33 engages the bottom edge of slot 28. Flange 52 will engage flange 53, on main beam 51. Clip 20 is shown fully seated in slot 48 of main beam 51 in FIGS. 11 and 12. The first lock between the main beam 51 and cross-beam 47 is completed at this position.

The opposing connector clip 20' is brought into engagement with the connector clip 20 by being inserted in a hooking action from the opposing side. It is this hooking action that is critical to the assembly since it permits the ridge 36' of 20' to by-pass the ridge 36 of 20 during insertion without interference and then have gaps 37 and 38 in the ridge 36 interlock with the gaps 37' and 38' in the ridge 36' in a relatively vertical movement. It is this movement which simultaneously completes the first and second locks. When interlocked, the relatively straight, rearwardly extending, edges 42 and 43 in gaps 37 and 38 abut relatively straight, rearwardly extending, front edges 42' and 43' in gaps 37' and 38', thus resisting any tension forces that tend to separate the connector clips.

Figure 14:
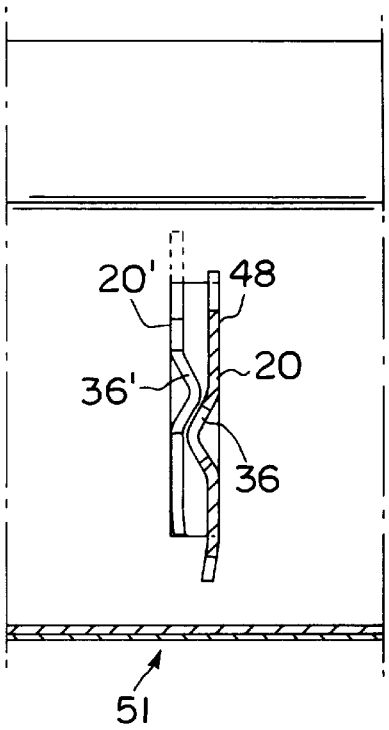
Figure 17:
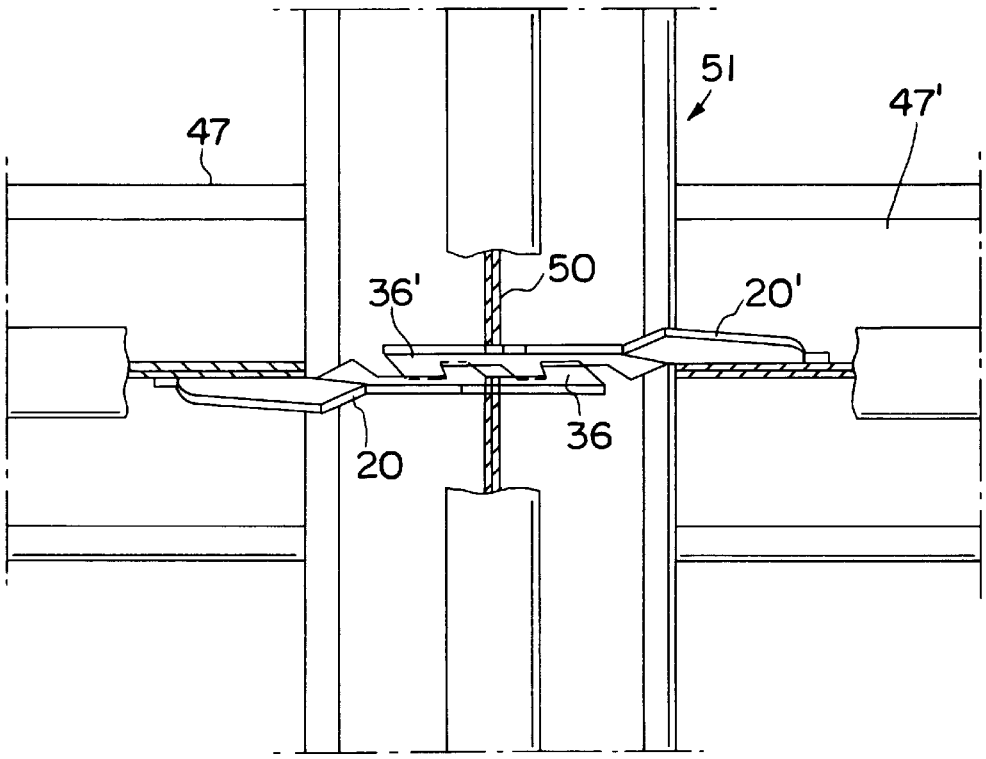

The hooking action, which results in an interlock of the gaps during assembly to form a second lock, can also be seen in the end sections as shown in FIGS. 14 and 16 as well as the top view of FIG. 17. During the insertion by a hooking action of the connector clip 20' as seen in FIG. 14, ridge 36' extends above ridge 36 of connector clip 20. When beam 47' and clip 20' are brought into a horizontal position, the gapped ridges 36 and 36' are interlocked into a second lock, whereby they exert substantial resistance against separation by tension from opposing forces exerted by beams 47 and 47' on connector clips 20 and 20' such as encountered during seismic disturbances.

The first and second locks are completed in this position.

Connector clips 20 and 20' also resist compressive forces by means of tabs 30 and 30' and the abutment of flanges 52 and 52' against flange 53 on main beam 51.

When tab 30 is formed in a solid manner, so that it extends substantially rearward so that it is not shearable, the front surface of the tab also presents a substantial resistance against compression.

Where rear edges 40 and 41 of gaps 37 and 38 of connector clip 20 are also not pointed, but are substantially straight, such interlocking back edges will also provide a resistance against compression.

When connector clips 20 and 20' are interlocked, as shown particularly in FIG. 15, hooks 32 and 32' will engage web 50 of main beam 51 to also resist withdrawing of the connector clips from the main beam.

Figure 18:
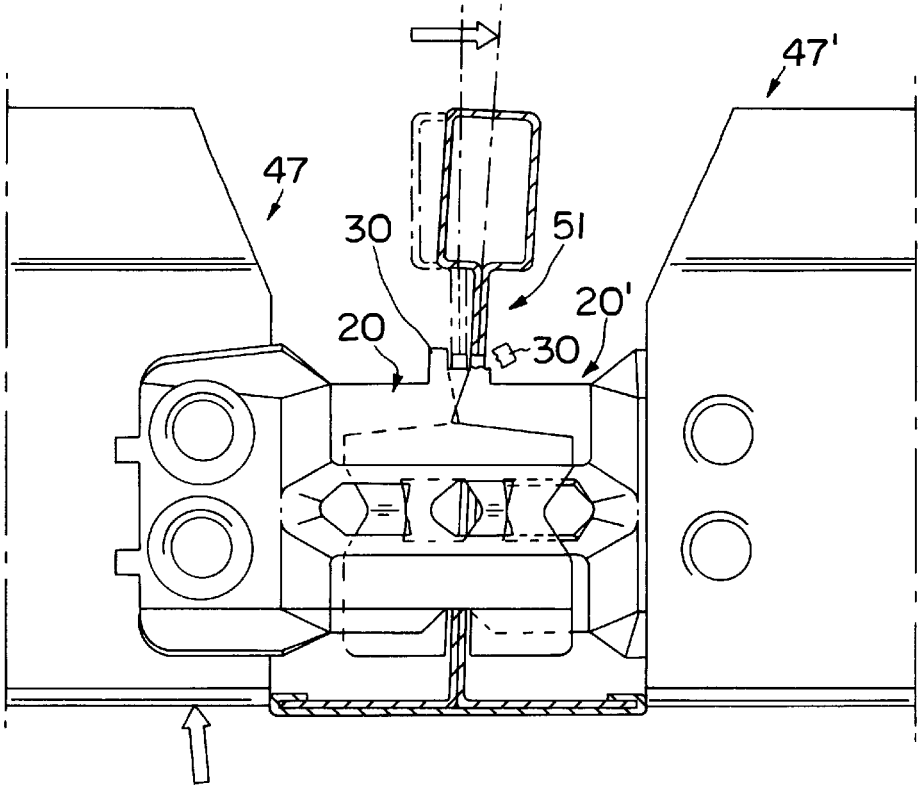
FIGS. 18 and 19 show the assembly being disassembled under restricted conditions.
Figure 19:
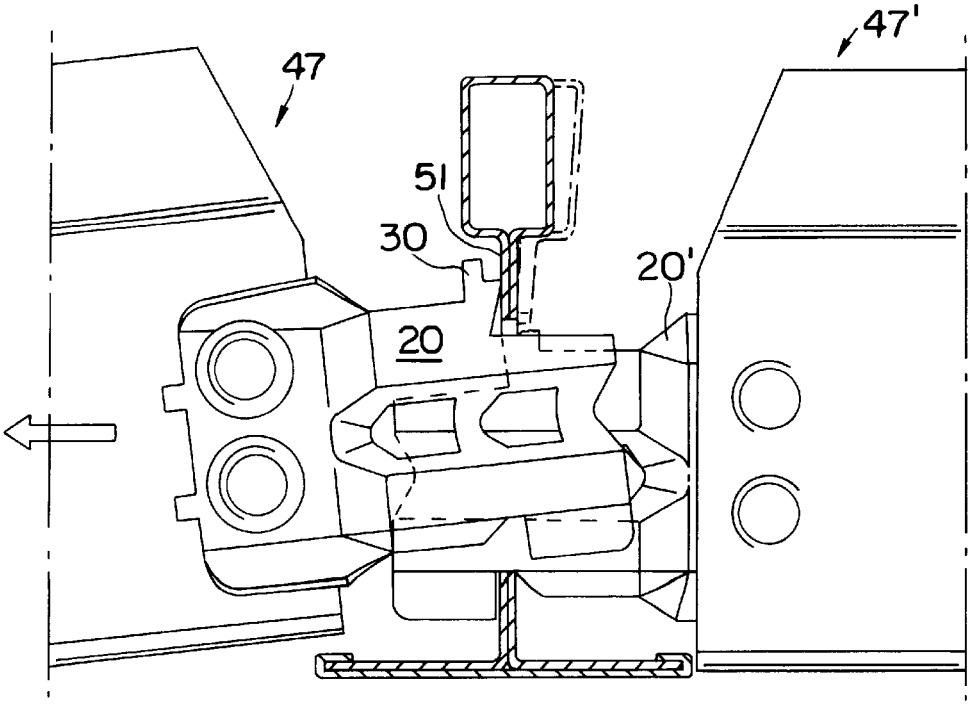

3. Disassembly of the Connector Clip Assembly Under Restricted Conditions as Seen in FIGS. 18–19

Where there is available room in a grid ceiling, an assembly may be disassembled in the reverse steps of the way it was assembled.

Where space is restricted, the assembly can be disassembled as shown in FIGS. 18 and 19. The main beam 51 is twisted to shear off a tab 30 as seen in FIG. 18. With the main beam held in twisted position, the main beam is clear of the recessed shelf 31, permitting in cross-beam 47 to be lifted up so that hook 32 clears web 50 of main beam 51, permitting cross-beam 47 to be withdrawn. Main beam 51 is permitted to resume its vertical web position with the web vertical. Beam 47 can be reinserted if desired and used without the sheared tab.

4. Clip Assembly Expansion Under Fire Conditions, as Seen in FIGS. 20 to 26

As seen in FIG. 20, as the beams expand under fire conditions, tab 30 on connector clip 20 is sheared off and the connector clip 20 rises within the slot 48 of main beam 51 as it rides on inclined surface 39. This raises ridge 36 slightly above ridge 36' as seen in FIG. 22, while the apexes of edges 40 and 41 of the rear of gaps 37 and 38 cause the ridges 36 and 36' to slide apart and separate from one another. Such movement of connector clip 20' occurs until a position as shown in FIG. 21 is reached.

Upon further expansions of cross-beams 47 and 47', tab 30' on connector clip 20' is sheared, and the same movement occurs, as occurred with beam 47, until full expansion occurs as shown in FIG. 26.

The expansion is permitted by the shearing of tabs 30 and 30', and the action of the apexes of edges 40 and 41. Where such tab is in effect a solid barrier, and the apexes of edges 40 and 41 are in straight edge form, rather than pointed into an apex, no such expansion occurs, since there is a substantial resistance against compressive forces, since the straight edges interfere with expansion. In either a fire resistant assembly, or a compression resistant assembly, the inventive feature of a hook action that permits interlocking of a middle section ridge and gaps of the connector clips remains the same.

When an increase in beam strength is desired, stitches 55 can be provided in the beam web is as disclosed in copending U.S. patent application Ser. No. 08/773,250 for Roll-formed Sections and Process of Producing Same. Such increase in strength is particularly helpful to prevent collapse of the beam during expansion from fire, where the assembly of the invention includes the embodiment which permits expansion from heat during a fire.

What is claimed is:

1. In a connector assembly for ceiling grid formed of main beams and cross-beams, wherein the beams have an inverted T cross-section with a vertical web and a flange at the bottom of the web:

a) a main beam (47) having a slot (48) in the web (50);

b) a pair of cross-beams (47, 47') each having one of a pair of identical clips (20, 20') connected at an end with both clips (20, 20') extending through the slot (48) of the main beam (51) from opposing directions;

the assembly having a first lock between each of the clips (20, 20') and the main beam (51) in the form of a hook (32, 32') that engages the web (50) of the main beam (51), the improvement comprising in combination a second lock between the cross-beams (47, 47') wherein a) each of the clips (20, 20') has a ridge (36, 36') in the clip (20, 20'), extending longitudinally of the cross-beams (47, 47'), with gaps (37, 38, 37', 38') in the ridge (36, 36');

b) the gaps (37, 38, 37', 38') in each one of the clips engages the ridge (36, 36') between the gaps in the other clip to form an interlock between the clips;

wherein the hook (32') and a substantially vertical shoulder (28') in the clip (20') form means to engage the second lock by a substantially downward vertical movement.

2. The assembly of claim 1 wherein each clip has a tab (30, 30') capable of being sheared by expansion of the cross-beams (47, 47') during a fire.

3. The assembly of claim 1 wherein a bottom ramp (39, 39') is capable of raising the clip in the slot (48, 48') during expansion caused by a fire to disengage the second lock.

4. The assembly of claim 1 wherein each of the gaps (37, 38, 37', 38') in the ridge (36, 36') includes an apex portion (40, 41, 40'41') that is capable of cooperating with an apex portion on the other clip in the assembly to disengage the second lock during expansion from fire.

5. An assembly as in any one of the preceding claims, in which the web of the beams has stitching.

6. A clip attached to the end of a cross beam capable of being assembled with another said clip on another cross beam, and a main beam, into an assembly, wherein the beams have an inverted T cross-section with a vertical web and a flange at the bottom of the web:

a) the main beam (47) has a slot (48) in the web (50);

b) each of the cross-beams (47, 47') has such clips (20, 20') connected at an end, with both clips (20, 20') extending through the slot (48) of the main beam (51) from opposing directions;

the assembly having a first lock between each of the clips (20, 20') and the main beam (51) in the form of a hook (32, 32') that engages the web (50) of the main beam (51), the improvement comprising, in the assembly, in combination, a second lock between the cross-beams (47, 47') wherein a) each of the clips (20, 20') has a ridge (36, 36') in the clip (20, 20'), extending longitudinally of the cross-beams (47; 47'), with gaps (37, 38, 37', 38') in the ridge (36, 36');

b) the gaps (37, 38, 37', 38') in each one of the clips engages the ridge (36, 36') between the gaps in the other clip to form an interlock between the clips;

wherein the hook (32') and a substantially vertical shoulder (28') in the clip (20') form means to engage the second lock by a substantially downward vertical movement.

7. The clip of claim 6 wherein a tab (30, 30') is capable of being sheared off by expansion of the cross-beams (47,47') during a fire.

8. The clip of claim 7 wherein a bottom ramp (39, 39') is capable of raising the clip in the slot (48, 48') during expansion to disengage the second lock.

9. The clip of claim 6 wherein each of the gaps (37, 38, 37', 38') in the ridge (36, 36') includes an apex portion (40, 41, 40'41') capable of disengaging the second lock during expansion from fire.

10. A clip as in any one of the preceding claims 6 through 9, in which the web of the beams has stitching.

* * * * *